US009948019B2

(12) United States Patent
Annis et al.

(10) Patent No.: US 9,948,019 B2
(45) Date of Patent: Apr. 17, 2018

(54) CABLE ASSEMBLY

(71) Applicant: TYCO ELECTRONICS CORPORATION, Berwyn, PA (US)

(72) Inventors: Kyle Gary Annis, Hummelstown, PA (US); Mitchell Kunane Storry, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/216,808

(22) Filed: Jul. 22, 2016

(65) Prior Publication Data

US 2018/0026387 A1 Jan. 25, 2018

(51) Int. Cl.

| | |
|---|---|
| ***H01R 13/428*** | (2006.01) |
| ***H01R 13/426*** | (2006.01) |
| ***H01R 13/502*** | (2006.01) |
| ***H01R 13/52*** | (2006.01) |

(52) U.S. Cl.
CPC ..... *H01R 13/426* (2013.01); *H01R 13/502* (2013.01); *H01R 13/5208* (2013.01)

(58) Field of Classification Search
CPC .. H01R 13/412; H01R 13/428; H01R 13/434; H01R 33/0845
USPC ..... 439/744, 745
See application file for complete search history.

(56) References Cited

U.S. PATENT DOCUMENTS 3,947,182 A * 3/1976 McCartney ..... G02B 6/3869 385/54
4,241,976 A * 12/1980 Oliver ..... H01R 13/426 29/458
4,421,378 A 12/1983 Sanford et al.
4,804,243 A * 2/1989 Borsuk ..... G02B 6/3821 385/76
5,690,518 A * 11/1997 Roy ..... H01R 13/02 439/825

(Continued)

FOREIGN PATENT DOCUMENTS

EP 1 788 667 A1 5/2007
EP 2 056 411 A2 5/2009

(Continued)

OTHER PUBLICATIONS

C&K; MDMA Series Microminiature Connectors with Removable Crimp Contacts; Apr. 2016; 8 pages.

(Continued)

*Primary Examiner* — Phuong Dinh

(57) ABSTRACT

A connector for a cable assembly includes a shell, a contact housing, and multiple finger clips. The contact housing is held in a chamber of the shell. The contact housing defines contact cavities extending through the contact housing between front and rear ends thereof. The finger clips are held in the contact cavities. The finger clips have deflectable latches. The contact cavities of the contact housing are configured to removably receive electrical contacts therein through the rear end. The deflectable latch of the finger clip in the corresponding contact cavity is configured to engage a retention shoulder of the electrical contact to removably secure the electrical contact in the contact cavity. The electrical contacts held in the contact housing are configured to mate with corresponding mating contacts of a mating connector.

20 Claims, 8 Drawing Sheets

(56) References Cited

U.S. PATENT DOCUMENTS

| | | | | |
|---|---|---|---|---|
| 6,193,549 | B1 * | 2/2001 | Suzuki | H01R 13/4223 439/511 |
| 8,029,322 | B1 * | 10/2011 | Oh | H01R 13/426 439/695 |
| 2008/0299832 | A1 | 12/2008 | Umemura et al. | |

FOREIGN PATENT DOCUMENTS

| | | |
|---|---|---|
| EP | 2 306 595 A1 | 4/2011 |
| GB | 2 355 346 A | 4/2001 |

OTHER PUBLICATIONS

International Search Report, Application No. PCT/IB2017/054329, International Filing Date, Jul. 18, 2017.

* cited by examiner

CABLE ASSEMBLY

BACKGROUND OF THE INVENTION

The subject matter herein relates generally to connectors mounted to cables.

Electrical connectors provide communicative interfaces between electrical components where power and/or signals may be transmitted therethrough. For example, the electrical connectors may be used within telecommunication equipment, servers, and data storage or transport devices. Typically, electrical connectors are used in environments, such as in offices or homes, where the connectors are not subjected to constant shock, vibration, and/or extreme temperatures. However, in some applications, such as aerospace or military equipment, the electrical connector must be configured to withstand certain environmental conditions and still effectively transmit power and/or data signals.

In some applications, electrical connectors are terminated to a plurality of electrical cables, which may be referred to as a cable harness. The electrical connectors may be assembled by crimping or soldering each cable to a corresponding electrical contact, seating the contacts in a housing, and then pouring an epoxy into a back cavity of the housing. Upon setting, the epoxy permanently locks the cable-terminated contacts within the housing. Therefore, the individual contacts and cables of the connector are not removable and replaceable. If one of the cables or one of the electrical contacts gets damaged during production or use of the connector, the entire connector may need to be discarded.

Accordingly, there is a need for a cable-mounted electrical connector that offers removable coupling of the electrical contacts to the housing.

BRIEF DESCRIPTION OF THE INVENTION

In one embodiment, a cable-mountable connector is provided including a shell, a contact housing, and multiple finger clips. The shell has a mating end and a cable end opposite the mating end. The shell defines a chamber extending through the shell between the mating and cable ends. The contact housing is held in the chamber of the shell and extends between a front end and a rear end. The contact housing defines contact cavities extending through the contact housing between the front and rear ends. The finger clips are held in the contact cavities of the contact housing. The finger clips have deflectable latches. The contact cavities of the contact housing are configured to removably receive electrical contacts therein through the rear end. The deflectable latch of the finger clip in the corresponding contact cavity is configured to engage a retention shoulder of the electrical contact to removably secure the electrical contact in the contact cavity. The electrical contacts held in the contact housing are configured to mate with a corresponding mating contact of a mating connector.

In another embodiment, a cable assembly is provided including a connector and multiple electrical contacts. The connector includes a shell, a contact housing, multiple finger clips, and multiple electrical contacts. The shell has a mating end and a cable end opposite the mating end. The shell defines a chamber extending through the shell between the mating and cable ends. The contact housing is held in the chamber of the shell and extends between a front end and a rear end. The contact housing defines contact cavities extending through the contact housing between the front and rear ends. The finger clips are held in the contact cavities of the contact housing. The finger clips have deflectable latches. The electrical contacts are removably received in the contact cavities through the rear end of the contact housing. The electrical contacts have mating segments disposed at least proximate to the front end of the contact housing for compliant mating with corresponding mating contacts of a mating connector. The electrical contacts include rear-facing retention shoulders that engage the deflectable latches of the finger clips in the corresponding contact cavities to removably secure the electrical contacts in the contact cavities.

DETAILED DESCRIPTION OF THE INVENTION

Figure 1:
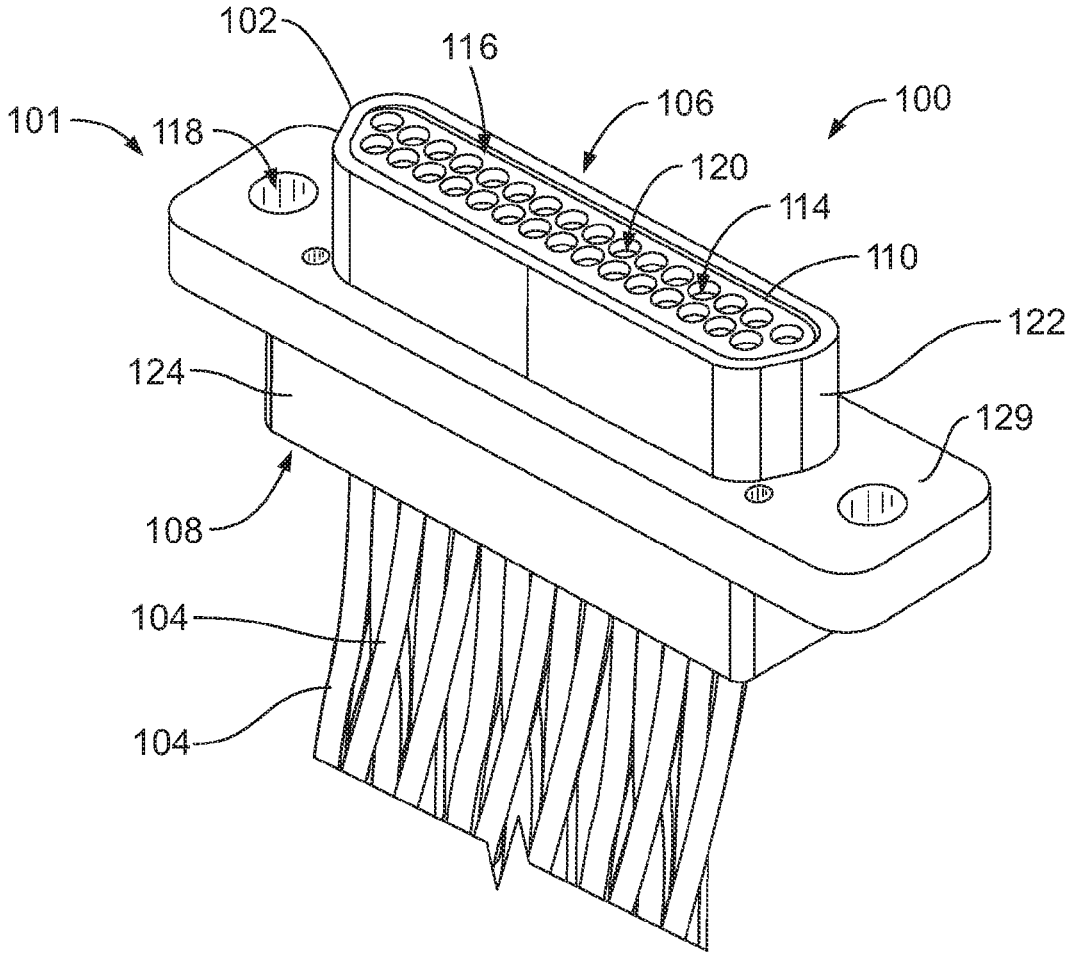
FIG. 1 is a perspective view of a cable assembly formed in accordance with an exemplary embodiment.

FIG. 1 is a perspective view of a cable assembly 100 formed in accordance with an exemplary embodiment. The cable assembly 100 includes a connector 101 and multiple electrical contacts 112 (shown in FIG. 2) that are terminated (for example, mechanically and electrically secured) to corresponding cables 104. The electrical contacts 112 are terminated to the cables 104, such as via crimping, soldering, welding, or the like. In an exemplary embodiment, the contacts 112 are removably coupled to the connector 101, such that individual contacts 112 and cables 104 can be removed and replaced and/or repositioned relative to the connector 101 after the cable assembly 100 is initially assembled.

The connector 101 includes a shell 102 that extends between a mating end 106 and a cable end 108 opposite the mating end 106. The mating end 106 is configured for mating with a mating connector. In the illustrated embodiment, the mating end 106 defines a plug configured to be mated with a receptacle connector; however, the mating end 106 may define a receptacle in alternative embodiments. A plurality of cables 104 extend from the cable end 108 of the shell 102. The cables 104 may each include one or more wires or core conductors surrounded by one or more insulation layers. Although not shown in FIG. 1, at least some of the cables 104 may be commonly surrounded by an insulation layer, such as an outer jacket or a tape layer, outside of the connector 101 to retain the cables 104 in proximity to one another.

Figure 2:
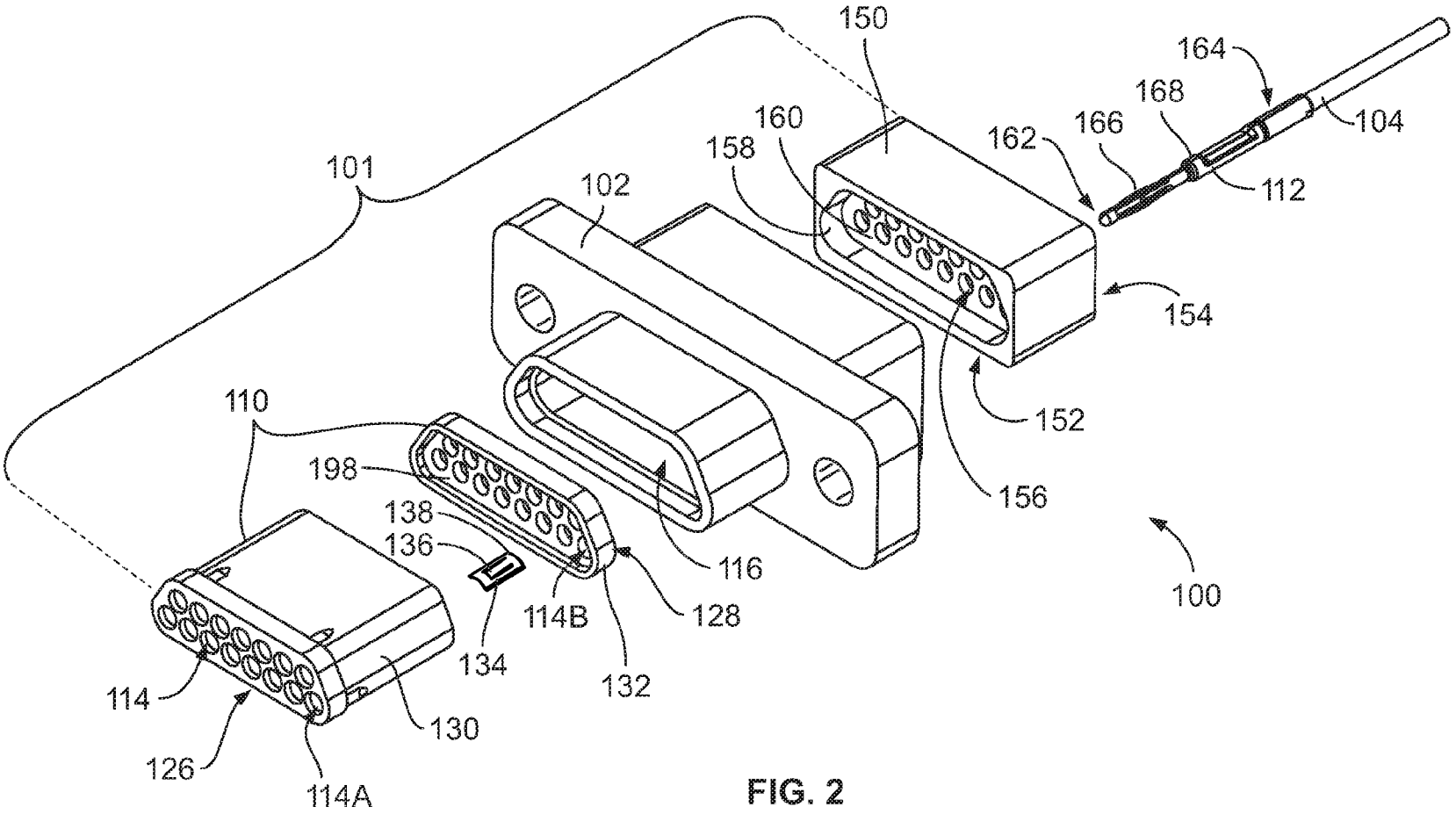
FIG. 2 is an exploded perspective view of the cable assembly according to an embodiment.

The shell 102 defines a chamber 116 extending through the shell 102 between the mating and cable ends 106, 108. The connector 101 also includes a contact housing 110 disposed in the chamber 116 of the shell 102. The contact housing 110 holds a plurality of the electrical contacts 112 (FIG. 2). For example, each contact 112 is terminated to a different one of the cables 104. The contact housing 110 defines a plurality of contact cavities 114 that receive corresponding contacts 112. In the illustrated embodiment, the contact cavities 114 proximate to the mating end 106 of the shell 102 are cylindrical openings having the contacts 112 arranged therein. The contact cavities 114 may receive corresponding mating contacts of a mating connector at the mating end 106 to allow the mating contacts to engage and electrically connect to the contacts 112. In the illustrated embodiment, the contact cavities 114 are arranged to define a pin mating interface 120 having a designated pattern. The pin mating interface 120 may be designed to meet a particular standard, such as MIL-DTL-83513, or other standards, for intermateability, interchangeability, and performance of a particular connector series. For example, the connector 101 may be a micro-D connector. The pin mating interface 120 in the illustrated embodiment includes 31 contact cavities 114 arranged in two rows, but the contact housing 110 may have a different number and/or arrangement of the contact cavities 114 in an alternative embodiment.

In the illustrated embodiment, the shell 102 includes a flange 129 between the mating end 106 and the cable end 108. The flange 129 includes mounting openings 118 for securing the shell 102 to the mating connector and/or to a structure (for example, to which the mating connector or the connector 101 is mounted). The shell 102 includes a tongue 122 extending forward from the flange 129 and defining the mating end 106 of the shell 102. The tongue 122 may be received at least partially within a shroud of the mating connector. The shell 102 further includes a well 124 (for example, a potting well 124) extending rearward from the flange 129 and defining the cable end 108 of the shell 102. Although not shown, the well 124 is at least partially open at the cable end 108 to allow to the cables 104 to exit the chamber 116. The shell 102 in an embodiment is composed of one or more metals, such as aluminum or stainless steel, but may be composed of other materials in other embodiments, such as a carbon fiber or another composite material.

Figure 3:
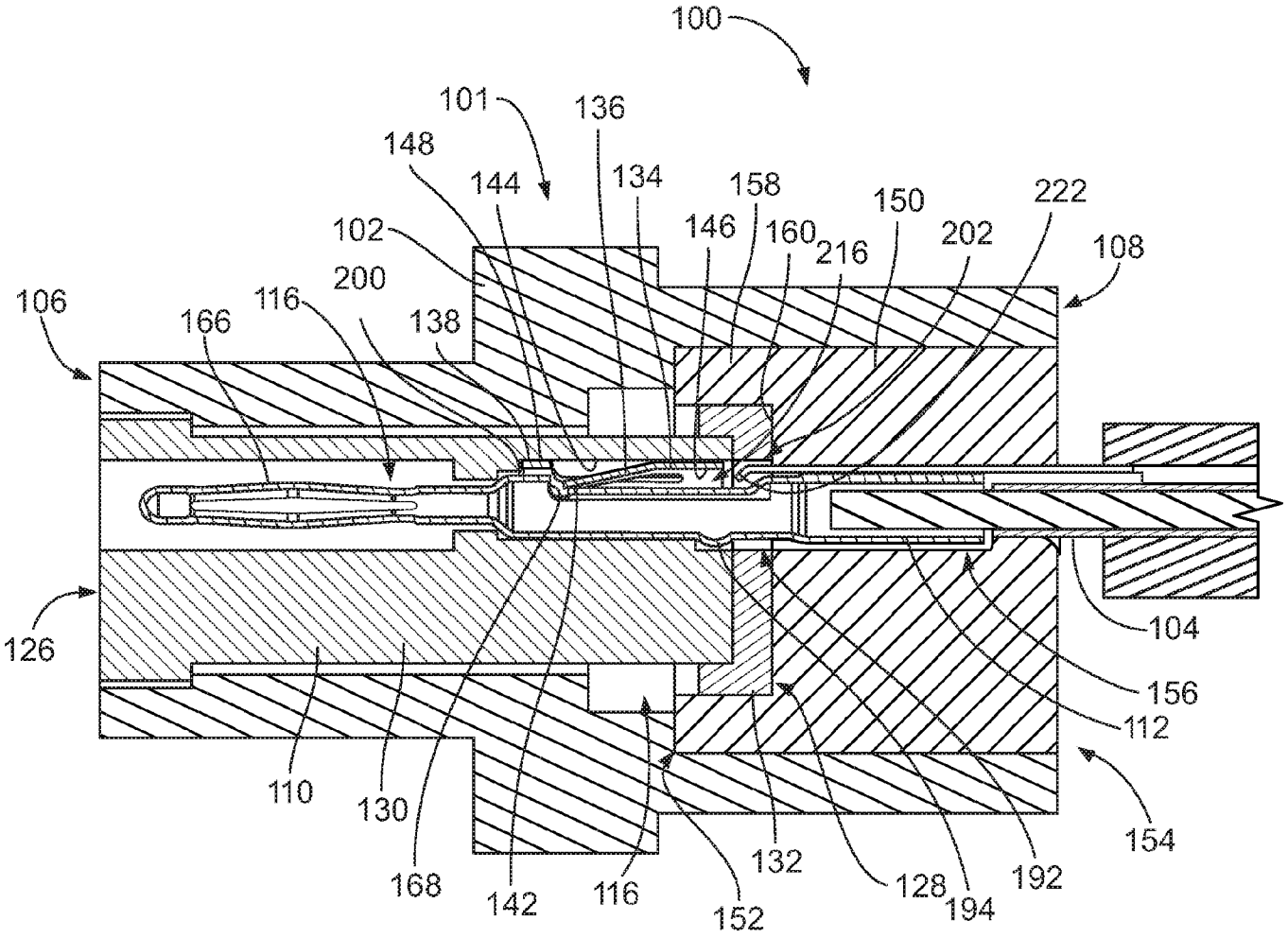
FIG. 3 is a side cross-sectional view of the cable assembly in an assembled state.

FIG. 2 is an exploded perspective view of the cable assembly 100 according to an embodiment. FIG. 3 is a side cross-sectional view of the cable assembly 100 in an assembled state. The cable assembly 100 in FIG. 3 is sectioned along a median plane that extends the length of the connector 101 between the mating and cable ends 106, 108 of the shell 102. The contact housing 110 extends between a front end 126 and an opposite rear end 128. The front end 126 may be approximately coplanar or flush with the mating end 106 of the shell 102, as shown in FIG. 3, when the contact housing 110 is disposed within the chamber 116. The contact cavities 114 extend fully through the contact housing 110 between the front and rear ends 126, 128. The contact housing 110 is composed of an electrically insulative material in an embodiment, such as one or more plastics or other dielectric materials.

Optionally, the contact housing 110 may be a multi-piece structure. For example, as shown in FIG. 2, the contact housing 110 may include a front housing 130 and a rear housing 132 that each form part of the contact housing 110. The front housing 130 defines the front end 126 of the contact housing 110, and the rear housing 132 defines the rear end 128. The front and rear housings 130, 132 each define respective front and rear portions of the contact cavities 114. For example, the front portions 114A of the contact cavities 114 defined in the front housing 130 at least partially align with and are fluidly connected to the rear portions 114B of the contact cavities 114 defined in the rear housing 132 when the front and rear housings 130, 132 are loaded in the shell 102. The front housing 130 optionally may be secured to the rear housing 132 at an interface using an adhesive, an epoxy, a mechanical fastener, or the like. The front and rear housings 130, 132 may be composed of the same or different materials.

The connector 101 includes finger clips 134 held in the contact cavities 114 of the contact housing 110. For example, although only one finger clip 134 is shown in FIGS. 2 and 3, each contact cavity 114 may include a corresponding finger clip. The illustrated finger clips 134 may be representative of the other finger clips. Additional reference is made to FIG. 4, which is a rear perspective view of the finger clip 134. The finger clips 134 each have a deflectable latch 136 extending from a body 138 of the finger clip 134. The deflectable latch 136 in an embodiment is cantilevered from the body 138. The latch 136 extends from a fixed end 140 attached to the body 138 to a free end 142 that is not attached to the body 138. In an embodiment, as shown in FIG. 3, the finger clip 134 is oriented in the contact cavity 114 such that the free end 142 is located frontward of the fixed end 140, meaning that the free end 142 is more proximate to the front end 126 of the contact housing 110 than a proximity of the fixed end 140 to the front end 126. The finger clip 134 is held in the contact cavity 114 such that the body 138 engages or is at least proximate to a peripheral wall 144 of the contact housing 110 defining the contact cavity 114. The deflectable latch 136, in a natural resting position or un-biased position, extends from the body 138 radially inward towards a radial center of the contact cavity 114. The latch 136 is configured to be deflected radially outwards towards the peripheral wall 144 by the electrical contact 112 as the electrical contact 112 is inserted into the contact cavity 114. The finger clip 134 in an embodiment is composed of one or more metals, and may be stamped and formed from a sheet.

Figure 4:
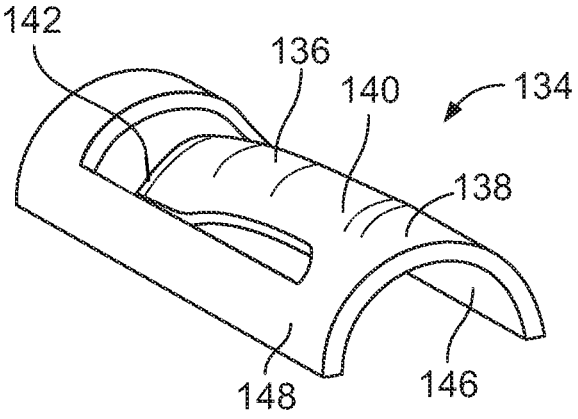
FIG. 4 is a rear perspective view of a finger clip of the cable assembly.

As shown in FIG. 4, the body 138 of the finger clip 134 is curved. The body 138 includes an inner side 146 and an opposite outer side 148. Within the contact cavity 114 of the contact housing 110, the outer side 148 engages or at least faces the peripheral wall 144 of the contact cavity 114, and the inner side 146 faces the electrical contact 112 received in the contact cavity 114. The finger clip 134 is curved to accommodate the electrical contact 112 moving beyond the finger clip 134 in the contact cavity 114. In an embodiment, the finger clip 134 may extend along approximately half of a perimeter of the contact cavity 114, although due to the body 138 being curved, the finger clip 134 occupies less than half of a cross-sectional area of the contact cavity 114 (to provide space for the contact 112). The finger clip 134 may have a semi-circular cross-sectional shape. In other embodiments, the finger clip 134 may extend along more or less than half of the perimeter of the contact cavity 114.

Referring back to FIGS. 2 and 3, the connector 101 further includes a grommet 150 that is held in the chamber 116 of the shell 102 rearward of the contact housing 110. The grommet 150 extends between a front end 152 and a rear end 154, and the front end 152 faces and/or receives the rear end 128 of the contact housing 110. The rear end 154 may be approximately coplanar or flush with the cable end 108 of the shell 102 when the grommet 150 is disposed in the chamber 116. The grommet 150 defines multiple apertures 156 that extend through the grommet 150 between the front and rear ends 152, 154. When assembled within the shell 102, the apertures 156 align with the contact cavities 114 of the contact housing 110. Therefore, the contact cavities 114 and the apertures 156 define respective segments of openings that extend continuously through the chamber 116 of the shell 102 between the mating end 106 and the cable end 108. The grommet 150 may engage the rear end 128 of the contact housing 110 at an interface, and may seal the interface to prevent debris and other contaminants from migrating into the contact cavities 114 of the contact housing 110. For example, the grommet 150 may include a rim 158 that extends from a front face 160 of the grommet 150 to the front end 152. The apertures 156 are located along the front face 160. The rim 158 extends around a perimeter of the front face 160. When loaded into the shell 102, the rear end 128 of the contact housing 110 is received within the rim 158 and may engage the front face 160, as shown in FIG. 3. The grommet 150 may be composed of a dielectric material, such as plastic, rubber, or the like. The grommet 150 may be at least partially compressible to allow the material of the grommet 150 to seal the apertures 156 around the electrical contacts 112 and/or cables 104 therein.

Once assembled, the connector 101 is configured to receive one or more of the electrical contacts 112 to form the cable assembly 100. Only one electrical contact 112 is shown in FIGS. 2 and 3, but other electrical contacts 112 are received into the connector 101 may be similar or identical to the illustrated electrical contact 112. The electrical contact 112 is elongated between a front 162 and a rear 164. The contact 112 has a mating segment 166 that defines the front 162. The cable 104 is terminated to the contact 112 and extends from the rear 164. The electrical contact 112 is terminated to the cable 104 via crimping, soldering, welding, or the like, outside of the connector 101. The electrical contact 112 is subsequently loaded through one of the apertures 156 of the grommet 150 into a corresponding contact cavity 114 of the contact housing 110. The electrical contact 112 is loaded, front 162 first, in a frontward direction from the rear ends 154, 128 of the grommet 150 and the contact housing 110, respectively, towards the front ends 152, 126. As shown in FIG. 3, when the contact 112 reaches a fully inserted position in the contact cavity 114, the deflectable latch 136 of the finger clip 134 engages a retention shoulder 168 of the electrical contact 112 to secure the electrical contact 112 in the contact cavity 114. The contact 112 is secured in the contact cavity 114 because the finger clip 134 blocks the contact 112 from backing out of the cavity 114 towards the cable end 108 of the shell 102. For example, the free end 142 of the latch 136 abuts against the retention shoulder 168 to mechanically block rearward movement of the contact 112.

The electrical contact 112 in the contact housing 110 is configured to mate with a corresponding mating contact of a mating connector. For example, as shown in FIG. 3, the mating segment 166 of the contact 112 is located within the contact cavity 114 at least proximate to the front end 126 to engage a mating contact. In the illustrated embodiment, the mating segment 166 is a compliant pin that is configured for compliant mating to a socket contact of the mating connector. In other various embodiments, the mating segment 166 may be a female pin having a socket configured to receive a male pin of the mating connector.

In an exemplary embodiment, the electrical contacts 112 are removably received and secured in the contact cavities 114, such that the electrical contacts 112 may be selectively removed from the contact cavities 114 without damaging the connector 101 or the contacts 112. The electrical contact 112 shown in FIG. 3 may be removed by forcing the deflectable latch 136 radially outward towards the peripheral wall 144 of the contact cavity 114 that engages or is at least proximate to the body 138 of the finger clip 134. In the illustrated embodiment, the latch 136 is deflected vertically upwards relative to the connector 101. Upon the free end 142 of the latch 136 moving to a clearance position that is radially outward of (for example, above) the retention shoulder 168 of the electrical contact 112, the latch 136 allows the contact 112 to back out of the contact cavity 114. For example, the contact 112 is able to be pulled rearward when the latch 136 is in the clearance position such that the retention shoulder 168 moves past the latch 136 without stubbing or catching on the free end 142. In an embodiment, the latch 136 is forced to the clearance position by a blade 306 (shown in FIG. 12) of a removal tool that enters the contact cavity 114 through the rear end 128. The blade 306 deflects the latch 136 radially outward as the blade 306 is moved longitudinally through the contact cavity 114 towards the front end 126. In an embodiment, the blade 306 extends through the corresponding aperture 156 of the grommet 150 before entering the contact cavity 114.

Since the cable assembly 100 has removable electrical contacts 112 relative to the connector 101, the cable assembly 100 may provide various technical advantages over known cable assemblies in which cable-mounted contacts are potted via an epoxy or the like into the connector housings and are not removable. For example, the cable assembly 100 is able to be serviced in the field without replacing the cable assembly 100 entirely. If one or more of the contacts 112 and/or cables 104 are damaged in the field, the damaged cable-mounted contacts 112 can be removed from the cable assembly 100 and replaced with new cable-mounted contacts 112. Furthermore, the removability allows for customization of the cable assembly 100, as an operator can select the number and the arrangement of cable-mounted contacts 112 secured in the connector 101.

Figure 6:
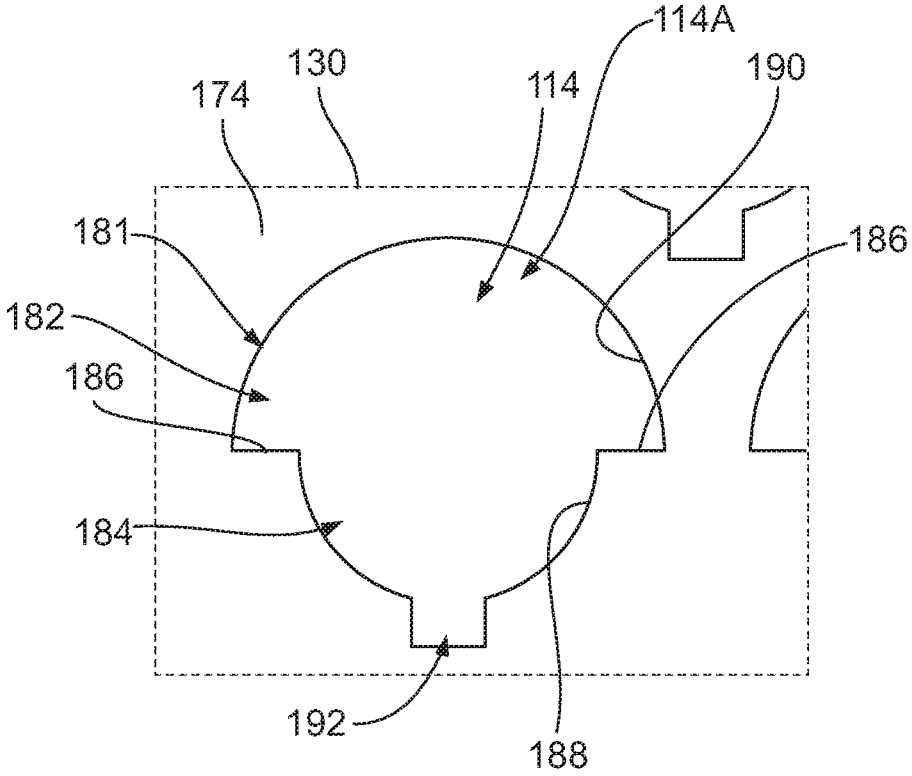
FIG. 6 is a close-up view of a rear face of the front housing showing a contact cavity.
Figure 5:
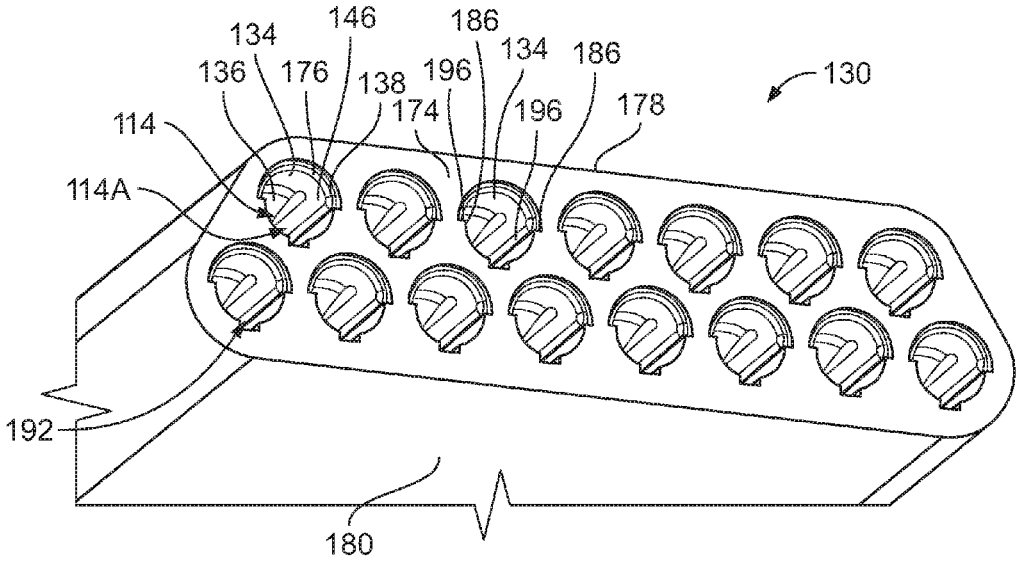
FIG. 5 is a rear perspective view of a portion of a front housing of a contact housing of the cable assembly according to an embodiment.
Figure 7:
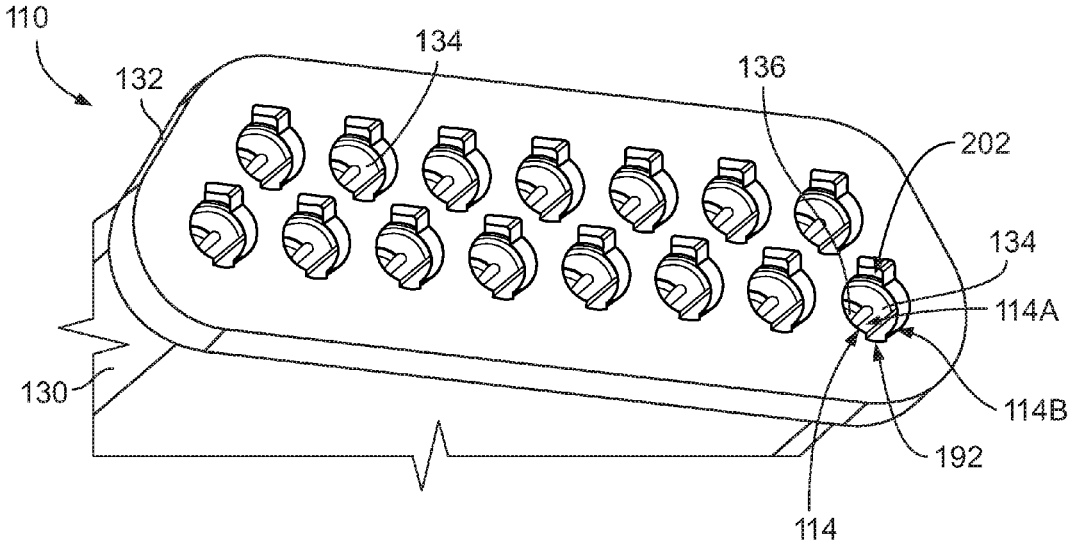
FIG. 7 is a rear perspective view of the contact housing with a rear housing secured to the front housing according to an embodiment.

FIG. 5 is a rear perspective view of a portion of the front housing 130 of the contact housing 110 according to an embodiment. FIG. 6 is a close-up view of a rear face 174 of the front housing 130 showing one of the contact cavities 114. FIG. 7 is a rear perspective view of the contact housing 110 with the rear housing 132 secured to the front housing 130 according to an embodiment. As shown in FIG. 5, the finger clips 134 are disposed within the front portions 114A of the contact cavities 114 defined by the front housing 130. The finger clips 134 have back ends 176 that are located flush with, or at proximate to, the rear face 174 of the front housing 130. Each contact cavity 114 receives one finger clip 134. In an exemplary embodiment, all of the finger clips 134 have a common orientation relative to the front housing 130 of the contact housing 110 (shown in FIG. 7). For example, the front housing 130 has a top side 178 and a bottom side 180. As used herein, relative or spatial terms such as "front," "rear," "top," "bottom," "first," and "second," are only used to distinguish the referenced elements and do not necessarily require particular positions or orientations relative to the surrounding environment of the cable assembly 100 (shown in FIG. 1). The finger clips 134 are angularly oriented relative to the front housing 130 such that the deflectable latches 136 are disposed along the top portions of the corresponding cavities 114. The common orientation of the finger clips 134 allows (and requires) the electrical contacts 112 (shown in FIG. 1) received in the cavities 114 to have common orientations for the latches 136 to properly engage and secure the contacts 112.

Referring now to FIG. 6, the contact cavities 114 (along the front portions 114A) may have a cross-sectional profile 181 that includes a clip region 182 and a reduced diameter region 184. The clip region 182 is disposed above the reduced diameter region 184 in the illustrated embodiment. The contact cavity 114 has a generally curved profile along both the clip region 182 and the reduced diameter region 184, although the clip region 182 has a greater radius and/or diameter than the reduced diameter region 184. The reduced diameter region 184 is sized sufficiently large to be able to accommodate an electrical contact 112. The front housing 130 includes ledges 186 at the interfaces between the clip region 182 and the reduced diameter region 184. The ledges 186 extend radially outward from a peripheral wall 188 of the reduced diameter region 184 to a peripheral wall 190 of the clip region 182. The two ledges 186 shown in FIG. 6 are disposed approximately midway along a height of the contact cavity 114 (between the top and bottom sides 178, 180 of the front housing 130) and extend generally parallel to each other.

The profile 181 of the contact cavity 114 optionally also includes a notch 192 extending radially outward from a perimeter of the cavity 114 along the reduced diameter region 184. The notch 192 is configured to receive a protrusion 194 (shown in FIG. 9) of one of the electrical contacts 112 therein as the electrical contact 112 is inserted into the contact cavity 114 to ensure that the electrical contact 112 is angularly aligned with the orientation of the finger clip 134 in the contact cavity 114. For example, if an operator inserting one of the cable-mounted contacts 112 into the connector 101 (shown in FIG. 3) experiences a stubbing force due to the protrusion 194 abutting against the rear end 128 of the contact housing 110, then the feedback indicates that the protrusion 194 is not angularly aligned with the notch 192, and the contact 112 is therefore not angularly aligned with the finger clip 134. As shown in FIGS. 5 and 7, the notches 192 may be defined in the rear portions 114B of the cavities 114 of the rear housing 132, and may also extend at least partially through the front portions 114A defined by the front housing 130. FIG. 3 shows the protrusion 194 of the contact 112 received in the notch 192 along the front housing 130. In an alternative embodiment, the notches 192 are only defined in the rear portions 114B of the cavities 114 defined by the rear housing 132, such that the protrusions 194 are within the rear housing 132 when the contacts 112 are fully inserted into the cavities 114.

Referring now to FIGS. 5 and 6, the finger clips 134 are disposed in the clip regions 182 of the front portions 114A of the contact cavities 114. The finger clips 134 are retained in the clip regions 182 by the ledges 186. For example, side edges 196 of the clips 134 may sit on the ledges 186. The finger clips 134 are curved to extend generally along the perimeters of the clip regions 182. The curved inner side 146 of the body 138 of each finger clip 134 has a radius that may be approximately equal to the radius of the reduced diameter region 184 of the corresponding contact cavity 114. Therefore, the finger clip 134 and the reduced diameter region 184 together define a perimeter of the contact cavity 114 (along the length of the finger clip 134). The inner side 146 of the finger clip 134 constructively defines a peripheral wall of the contact cavity 114. As an electrical contact 112 is received into the contact cavity 114, the finger clip 134 surrounds a circumferential portion of the contact 112, and the reduced diameter region 184 surrounds a remaining circumferential portion of the contact 112.

Referring now to FIGS. 5 and 7, the contact housing 110 is assembled by securing the rear housing 132 to the front housing 130 with the finger clips 134 already disposed within the front portions 114A of the contact cavities 114 defined by the front housing 130. In an embodiment, the rear housing 132 is configured to lock the finger clips 134 within the contact cavities 114 when the rear housing 132 is secured to the front housing 130. For example, the rear portions 114B of the contact cavities 114 have a smaller cross-sectional size, a different cross-sectional shape, and/or are slightly offset from the front portions 114A defined by the front housing 130, so a front face 198 (shown in FIG. 2) of the rear housing 132 blocks the finger clips 134 from moving rearward out of the front portions 114A of the cavities 114. In an embodiment, the rear portions 114B have a radius and/or diameter that is approximately equal to the reduced diameter region 184 of the front portions 114B. The finger clips 134 in the clip regions 182 have larger outer diameters than the diameters of the rear portions 114B, so the back ends 176 of the finger clips 134 abut against the rear housing 132 proximate to the edges of the rear portions 114B. However, the cable-mounted electrical contacts 112 are able to fit within the rear portions 114B to be received in the contact cavities 114. As shown in FIG. 3, the finger clips 134 may each be configured to abut against a rear-facing shoulder 200 in the contact cavity 114 to block axial movement of the finger clip 134 towards the front end 126 of the contact housing 110.

In an embodiment, the rear portions 114B of the contact cavities 114 defined by the rear housing 132 each include a clearance indent 202 extending radially outward from a perimeter of the contact cavity 114. The clearance indent 202 in the illustrated embodiment is located along a top of the corresponding contact cavity 114, but may have other angular locations along the perimeter of the contact cavity 114 in other embodiments. The clearance indent 202 aligns angularly with the deflectable latch 136 of the finger clip 134 disposed within the corresponding contact cavity 114. The clearance indent 202 provides a path for a removal tool and/or an insertion tool to enter the contact cavity 114 to manipulate the corresponding electrical contact 112 relative to the contact cavity 114. The clearance indent 202 is used for ensuring that the removal and/or insertion tool is properly aligned relative to the finger clip 134. In the illustrated embodiment the clearance indent 202 is located along the rear portion 114B of each contact cavity 114, and is not located along the front portion 114A defined by the front housing 130.

Figure 8:
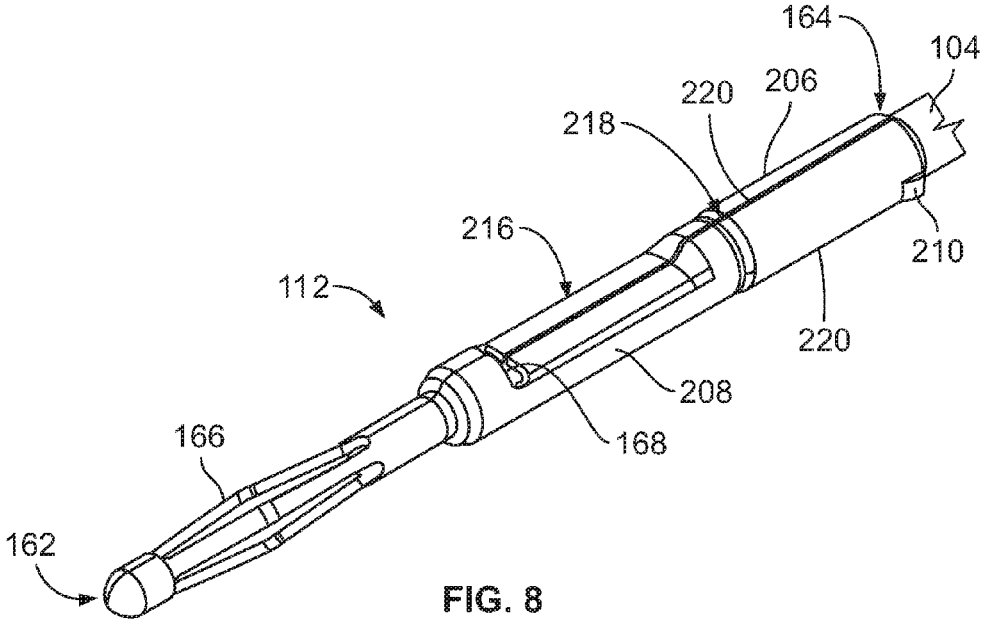
FIG. 8 is a perspective view of one of the electrical contacts of the cable assembly 100 terminated to a cable according to an embodiment.
Figure 9:
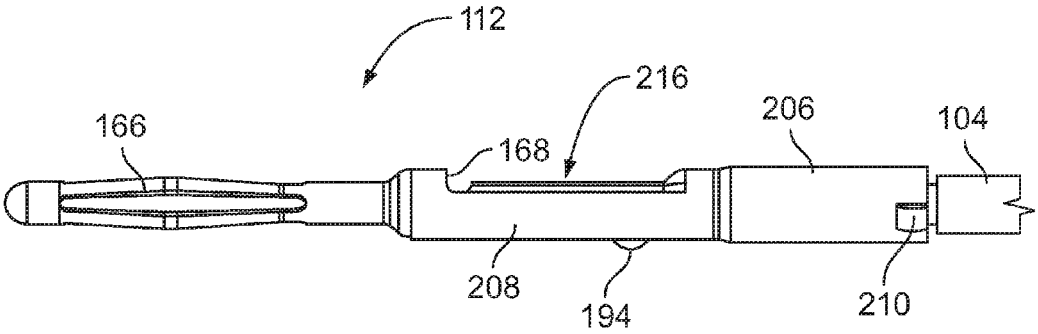
FIG. 9 is a side view of the electrical contact of FIG. 8.
Figure 10:
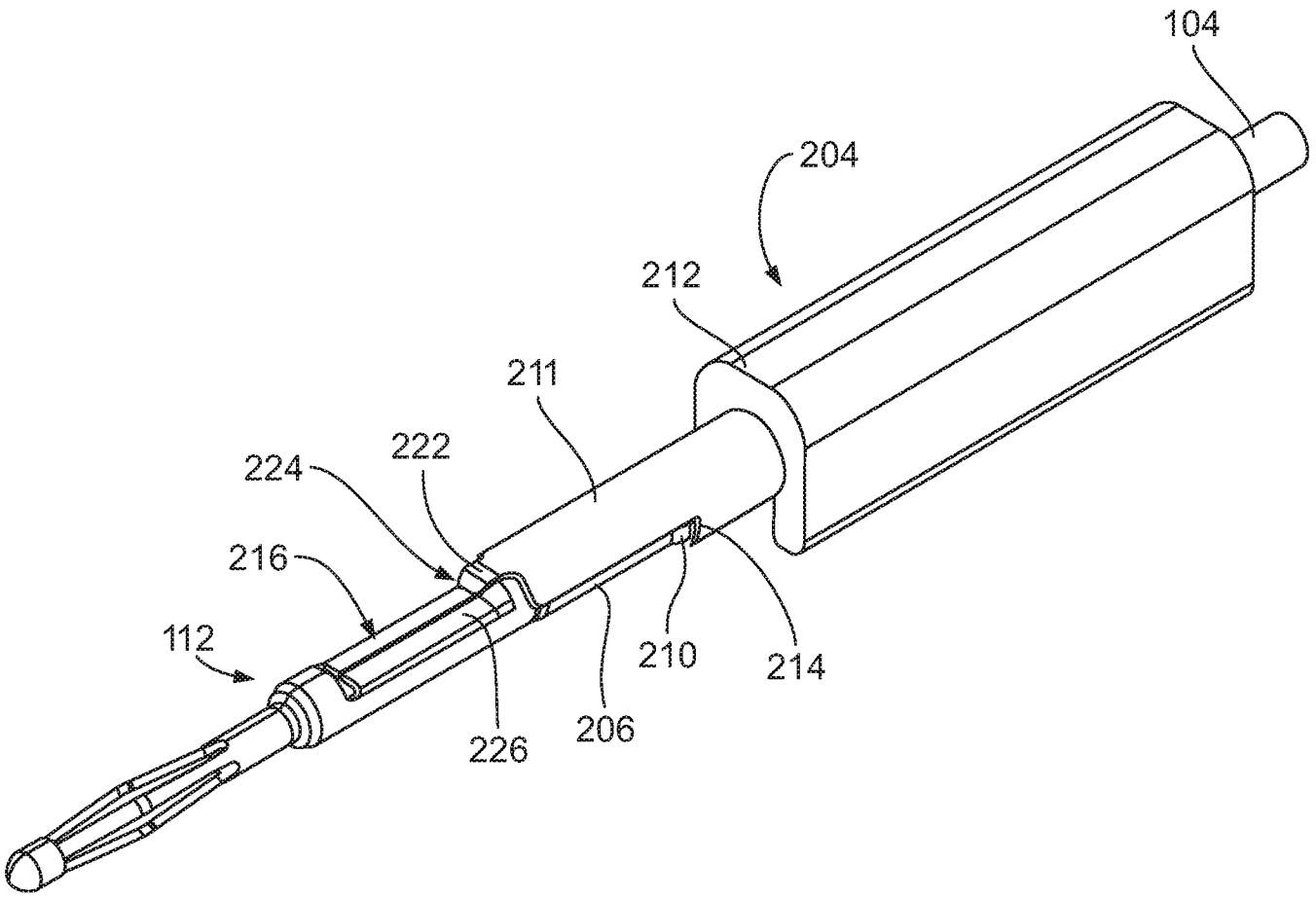
FIG. 10 is a perspective view of the electrical contact of FIG. 8 with an insertion tool for loading the contact into a connector of the cable assembly.

FIG. 8 is a perspective view of one of the electrical contacts 112 of the cable assembly 100 (shown in FIG. 1) terminated to a cable 104 according to an embodiment. FIG. 9 is a side view of the electrical contact 112 of FIG. 8. FIG. 10 is a perspective view of the electrical contact 112 of FIG. 8 with an insertion tool 204 for loading the contact 112 into the connector 101 (shown in FIG. 3). The electrical contact 112 includes the mating segment 166 at the front 162 and a termination barrel 206 rearward of the mating segment 166 at the rear 164. The termination barrel 206 surrounds and mechanically and electrically connects to an end of the cable 104. For example, the termination barrel 206 may be crimped, soldered, welded, or otherwise mechanically secured to the cable 104. The termination barrel 206 is generally cylindrical. The termination barrel 206 includes at least one push tab 210 that extends radially outward from a cylindrical outer perimeter of the barrel 206. The push tab 210 may be formed by a shearing process, a stamping process, a molding process, or the like. Alternatively, the push tab 210 may be formed inherently during a crimping process that terminates the contact 112 to the cable 104, as the compressive forces applied to the barrel 206 may cause the barrel 206 at the rear 164 to bulge outward relative to a compressed area of the barrel 206. As shown in FIG. 10, the push tab 210 is engaged by the insertion tool 204 shown in FIG. 10 to allow the tool 204 to push the cable-mounted electrical contact 112 into the contact cavity 114 (FIG. 3) of the connector 101 (FIG. 3). For example, the insertion tool 204 includes an arm 211 extending from a handle 212. The tool 204 further includes a ridge 214 protruding from the arm 211. The arm 211 and the handle 212 are curved to at least partially cradle the electrical contact 112, and the ridge 214 abuts against the push tab 210.

The electrical contact 112 defines a depressed region 216 rearward of the mating segment 166. The diameter of the generally-cylindrical contact 112 is reduced along the depressed region 216 relative to areas of the contact 112 in front of and rearward of the depressed region 216. The rear-facing retention shoulder 168 of the electrical contact 112 that is configured to engage the deflectable latch 136 (FIG. 3) of the finger clip 134 (FIG. 3) defines a front end of the depressed region 216. In an embodiment, the depressed region 216 is disposed along an intermediate segment 208 of the contact 112 that is axially between the mating segment 166 and the termination barrel 206. In another embodiment, the depressed region 216 may be located along the termination barrel 206. As shown in FIG. 3, when the electrical contact 112 is in the fully inserted position in the contact cavity 114, the latch 136 is received in the depressed region 216. For example, the portion of the contact 112 in front of the depressed region 216 is configured to force the latch 136 to deflect radially outward. Once the rear-facing retention shoulder 168 moves beyond the free end 142 of the latch 136, the latch 136 resiliently returns towards an unbiased position by moving radially inward into the depressed region 216 of the contact 112. Rearward movement of the electrical contact 112 causes the rear-facing retention shoulder 168 to engage and abut against the free end 142 of the latch 136, securing the contact 112 in the cavity 114 by blocking additional rearward movement of the contact 112.

In an exemplary embodiment, the electrical contact 112 is stamped and formed into the generally cylindrical shape from a sheet of metal. For example, the electrical contact 112 includes a seam 218 that extends the length of the contact 112 between the front 162 and the rear 164. The seam 218 is defined between rolled edges 220 of the sheet that are rolled towards each other to define the generally cylindrical shape of the contact 112. The rear-facing retention shoulder 168 optionally may be formed by shearing or cutting the contact 112 to define a sheared edge.

In the illustrated embodiment, the depressed region 216 does not extend along a full perimeter of the contact 112, but is located along a top portion of the contact 112. Since the depressed region 216 does not extend around a full perimeter of the contact 112, the contact 112 must be angularly aligned with the finger clip 134 when the contact 112 is inserted into the corresponding contact cavity 114 in order for the latch 136 to align with and engage the retention shoulder 168. As shown in FIG. 10, the insertion tool 204 includes a finger 222 at a distal end 224 of the arm 211. The finger 222 is curved relative to the arm 211. When the insertion tool 204 engages an electrical contact 112, the arm 211 cradles the termination barrel 206 and the finger 222 extends into the depressed region 216. The finger 222 may abut against a base surface 226 of the contact 112 along the depressed region 216 in order to rotationally fix the contact 112 to the insertion tool 204 so the contact 112 cannot rotate relative to the tool 204. The insertion tool 204 optionally may be rotationally fixed to the contact 112, instead of or in addition to the finger 222, via engagement of the one or more push tabs 210 of the contact 112 with corresponding edges of the arm 211 of the tool 204.

As shown in FIG. 9, the protrusion 194 of the contact 112 is spaced apart angularly from the depressed region 216. For example, the protrusion 194 shown in FIG. 9 is located along a bottom portion of the contact 112, approximately 180 degrees from the depressed region 216 at the top portion. The protrusion 194 may be formed by stamping, shearing, or molding a metal material of the contact 112. As described above, the protrusion 194 is used for ensuring that the contact 112 aligns with the finger clip 134 as the contact 112 is loaded into the corresponding contact cavity 114. For example, the protrusion 194 is received within the notch 192 (shown in FIG. 3) of the contact housing 110 when the contact 112 is properly aligned with the contact housing 110 and the finger clip 134 held therein.

Figure 11:
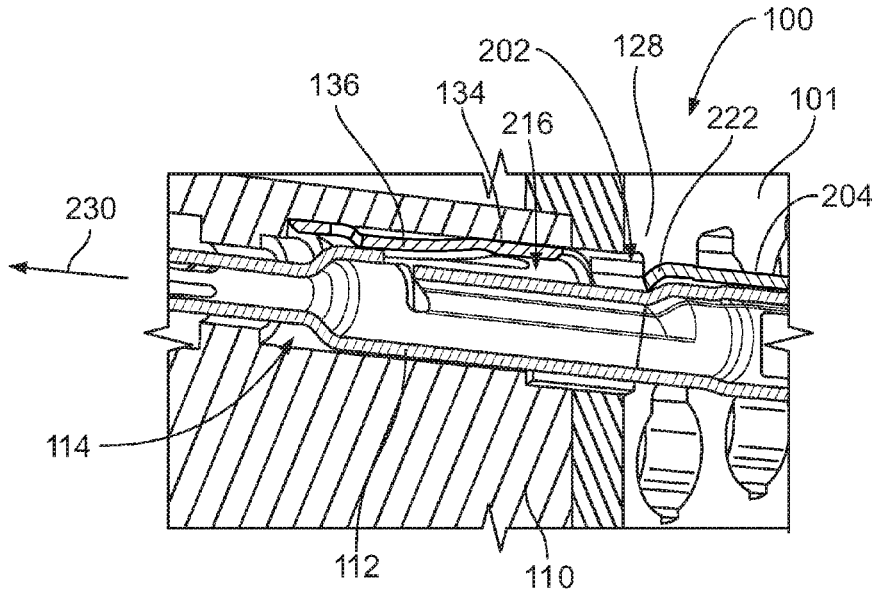
FIG. 11 is a cross-sectional view of a portion of the cable assembly showing an electrical contact that is misaligned relative to the connector according to an embodiment.

FIG. 11 is a cross-sectional view of a portion of the cable assembly 100 showing an electrical contact 112 that is misaligned relative to the connector 101 according to an embodiment. Since the contact 112 is angularly misaligned relative to the deflectable latch 136 of the finger clip 134, the latch 136 cannot be received properly in the depressed region 216 to reliably secure the contact 112 in the cavity 114. The cable assembly 100 is configured to provide stubbing feedback to an operator operating the insertion tool 204 when the contact 112 is misaligned. For example, before the contact 112 reaches the fully inserted position in the cavity 114, the finger 222 of the insertion tool 204 abuts against the rear end 128 of the contact housing 110, which blocks further movement of the contact 112 and the tool 204 in a forward loading direction 230. If, on the other hand, the contact 112 is aligned with the finger clip 134, the finger 222 of the insertion tool 204 is configured to be received in the clearance indent 202 instead of abutting against the rear end 128. FIG. 3 shows the finger 222 disposed in the clearance indent 202. Optionally, the protrusion 194 (shown in FIG. 9) of the contact 112 may be configured to abut against the rear end 128 of the contact housing 110 instead of, or in addition to, the finger 222 of the insertion tool 204 when the contact 112 is misaligned to prevent the contact 112 from reaching the fully inserted position. When the contact 112 is aligned properly, as shown in FIG. 3, the protrusion 194 is received in the notch 192 to allow the contact 112 to be fully loaded into the cavity 114.

Figure 12:
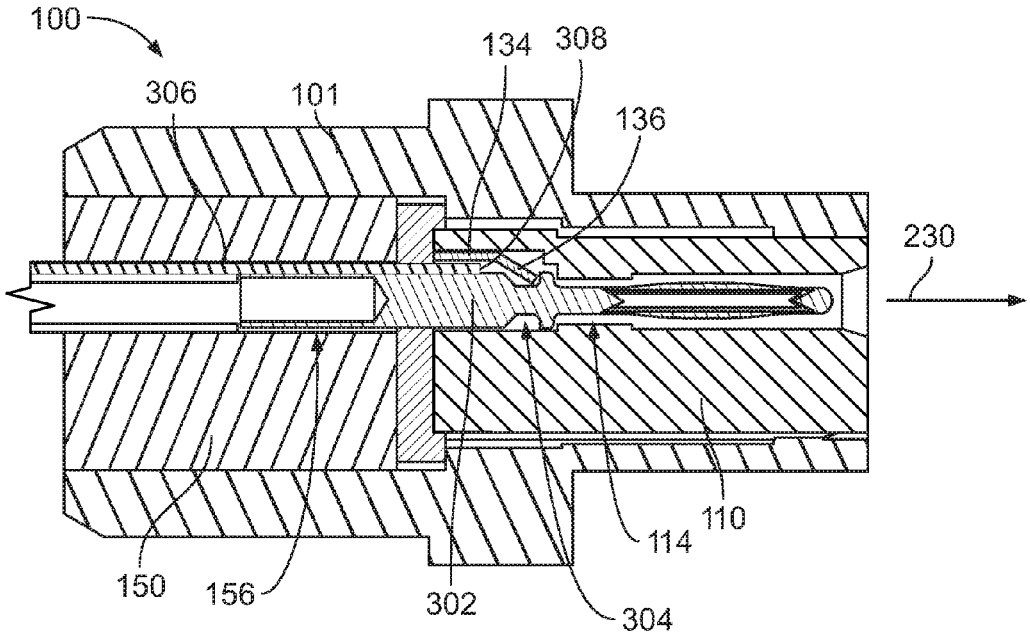
FIG. 12 is a side cross-sectional view of the cable assembly according to an alternative embodiment.

FIG. 12 is a side cross-sectional view of the cable assembly 100 according to an alternative embodiment. The cable assembly 100 includes a cable-mounted electrical contact 302 that is formed via machining instead of stamping and forming. The contact 302 includes a depressed region 304 that extends fully around a circumference of the contact 302, so angular alignment between the contact 302 and the deflectable latch 136 of the finger clip 134 in the cavity 114 is not a concern. For example, the latch 136 can enter the depressed region 304 regardless of the relative angular orientation between the contact 302 and the finger clip 134.

The contact 302 is removably secured to the connector 101 in the illustrated embodiment. In an embodiment, the contact 302 is configured to be removed by a removal tool (not shown) that includes an elongated blade 306. The tool is manipulated to insert the blade 306 into the aperture 156 of the grommet 150 and the contact cavity 114 of the contact housing 110. The blade 306 is disposed between the contact 302 and the deflectable latch 136 in the cavity 114. Movement of the removal tool in the forward loading direction 230 causes a distal tip 308 of the blade 306 to engage and deflect the latch 136 radially outward until the latch 136 reaches a clearance position. The contact 302 is able to be pulled rearward out of the cavity 114 when the latch 136 is in the clearance position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable-mountable connector comprising:

a shell having a mating end and a cable end opposite the mating end, the shell defining a chamber extending through the shell between the mating and cable ends;

a contact housing held in the chamber of the shell and extending between a front end and a rear end, the contact housing defining contact cavities extending through the contact housing between the front and rear ends; and multiple finger clips held in the contact cavities of the contact housing, the finger clips having curved bodies and deflectable latches extending from the curved bodies, each curved body extending along less than an entirety of a perimeter of the corresponding contact cavity, all of the finger clips in the contact cavities having a common angular orientation relative to the contact housing, wherein the contact cavities of the contact housing are configured to removably receive electrical contacts therein through the rear end, the deflectable latch of the finger clip in the corresponding contact cavity configured to engage a retention shoulder of the electrical contact to removably secure the electrical contact in the contact cavity, the electrical contacts held in the contact housing configured to mate with corresponding mating contacts of a mating connector.

2. The connector of claim 1, wherein the deflectable latches of the finger clips in the contact cavities are configured to be deflected radially outward towards a peripheral wall of the corresponding contact cavity by a blade of a removal tool that enters the contact cavity through the rear end, the latch disengaging the retention shoulder of the electrical contact upon deflecting outward to allow removal of the electrical contact from the contact cavity.

3. The connector of claim 1, wherein the contact cavities at the rear end of the contact housing include a clearance indent extending radially outward from the perimeter of the contact cavity, the clearance indent angularly aligning with the deflectable latch of the finger clip, the clearance indent providing a path for at least one of a removal tool or an insertion tool to enter the contact cavity to move the corresponding electrical contact relative to the contact cavity.

4. The connector of claim 1, further comprising a grommet held in the chamber of the shell, the grommet extending between a front end and a rear end, the front end facing the rear end of the contact housing, the grommet defining apertures through the grommet between the front and rear ends that align with the contact cavities of the contact housing, the grommet composed of a dielectric material.

5. The connector of claim 1, wherein the contact cavities have a cross-sectional profile that includes clip region and a reduced diameter region, the contact housing including a ledge at each of two interfaces between the clip region and the reduced diameter region, the finger clip disposed in the clip region and configured to engage the ledges to retain an orientation of the finger clip relative to the contact housing.

6. The connector of claim 5, wherein the contact cavities at the rear end of the contact housing include a notch extending radially outward from the perimeter of the contact cavity along the reduced diameter region, the notch configured to receive a protrusion of one of the electrical contacts therein as the electrical contact is inserted into the contact cavity to ensure that the electrical contact is angularly aligned with the finger clip in the contact cavity.

7. The connector of claim 5, wherein the curved body of each finger clip includes an outer side and an inner side, the outer side facing a peripheral wall of the contact cavity along the clip region, the inner side of the curved body having a radius approximately equal to a radius of the reduced diameter region of the contact cavity.

8. The connector of claim 1, wherein the deflectable latches of the finger clips are cantilevered and extend from a fixed end attached to a body of the respective finger clip to a free end that is not attached to the body, the free end disposed more proximate to the front end of the contact housing than a proximity of the fixed end to the front end.

9. The connector of claim 1, wherein the contact housing is defined by a front housing and a rear housing that are secured together, the front housing defining the front end of the contact housing and the rear housing defining the rear end, the front and rear housings defining respective front and rear portions of the contact cavities, the finger clips held in the front portions of the contact cavities, the rear portions of the contact cavities having at least one of a smaller cross-sectional size or a different cross-sectional shape than the front portions such that the rear housing blocks the finger clips from moving rearward out of the front portions of the contact cavities.

10. The connector of claim 1, wherein the curved bodies of the finger clips are generally semi-circular and extend along approximately half of the perimeter of the corresponding contact cavity.

11. A cable assembly comprising:

a connector including a shell, a contact housing, and multiple finger clips, the shell having a mating end and a cable end opposite the mating end, the shell defining a chamber extending through the shell between the mating and cable ends, the contact housing held in the chamber of the shell and extending between a front end and a rear end, the contact housing defining contact cavities extending through the contact housing between the front and rear ends, the finger clips held in the contact cavities of the contact housing, the finger clips having deflectable latches, the contact cavities each defining a notch extending outward from a perimeter of the contact cavity; and multiple electrical contacts removably received in the contact cavities through the rear end of the contact housing, the electrical contacts having mating segments disposed at least proximate to the front end of the contact housing for compliant mating with corresponding mating contacts of a mating connector, the electrical contacts including rear-facing retention shoulders that engage the deflectable latches of the finger clips in the corresponding contact cavities to removably secure the electrical contacts in the contact cavities, wherein the rear-facing shoulder of each electrical contact extends along less than an entirety of a perimeter of the electrical contact, the electrical contacts each including a protrusion extending radially outward from the electrical contact at a location along the perimeter of the electrical contact that is angularly spaced apart from the rear-facing shoulder, the protrusion configured to be received in the notch of the corresponding contact cavity as the electrical contact is received in the contact cavity to ensure that the rear-facing shoulder of the electrical contact is angularly aligned with the deflectable latch of the finger clip in the contact cavity.

12. The cable assembly of claim 11, wherein the electrical contacts include the mating segment, a termination barrel surrounding and mechanically and electrically connecting to an end of an electrical cable that extends from the cable end of the shell, and an intermediate segment between the termination barrel and the mating segment, the intermediate segment defining the rear-facing retention shoulder.

13. The cable assembly of claim 11, wherein the electrical contacts are stamped and formed into a generally cylindrical shape from a sheet of metal, the electrical contacts defining a seam along a length of the electrical contact.

14. The cable assembly of claim 11, wherein the electrical contacts include a termination barrel disposed rearward of the mating segment, the termination barrel surrounding and mechanically and electrically connecting to an end of an electrical cable, the termination barrel including at least one push tab extending radially outward from a cylindrical outer perimeter of the termination barrel, the push tab configured to be engaged by an insertion tool to load the electrical contact into a corresponding one of the contact cavities of the contact housing.

15. The cable assembly of claim 11, wherein the electrical contacts define a depressed region rearward of the mating segment, the deflectable latch of the finger clip within a same contact cavity as the corresponding electrical contact being received in the depressed region, the rear-facing retention shoulder of the electrical contact defining a front of the depressed region, the protrusion of the electrical contact being angularly spaced apart from the depressed region and the rear-facing retention shoulder along the perimeter of the electrical contact.

16. The cable assembly of claim 11, further comprising a grommet held in the chamber of the shell, the grommet composed of a dielectric material and extending between a front end and a rear end, the front end facing the rear end of the contact housing, the grommet defining apertures through the grommet between the front and rear ends that align with the contact cavities of the contact housing, the apertures receiving the electrical contacts therein.

17. The cable assembly of claim 11, wherein the mating segments of the electrical contacts are compliant pins configured for compliant mating with corresponding socket contacts of the mating connector.

18. The cable assembly of claim 11, wherein the contact housing is defined by a front housing and a rear housing that are secured together, the front housing defining the front end of the contact housing and the rear housing defining the rear end, the front and rear housings defining respective front and rear portions of the contact cavities, the finger clips held in the front portions of the contact cavities, the rear portions of the contact cavities having at least one of a smaller cross-sectional size or a different cross-sectional shape than the front portions such that the rear housing blocks the finger clips from moving rearward out of the front portions of the contact cavities.

19. The cable assembly of claim 11, wherein each of the contact cavities of the contact housing has a cross-sectional profile that includes clip region and a reduced diameter region, the contact housing including a ledge at each of two interfaces between the clip region and the reduced diameter region in each contact cavity, the finger clips disposed in the clip regions of the contact cavities and configured to engage the ledges to retain an orientation of the finger clips relative to the contact housing.

20. The cable assembly of claim 19, wherein all of the contact cavities of the contact housing have a common angular orientation relative to the contact housing.

* * * * *